US006782673B2

(12) United States Patent
Azar

(10) Patent No.: US 6,782,673 B2
(45) Date of Patent: Aug. 31, 2004

(54) CONCRETE BLOCK FOR USE IN FENCE OR BUILDING CONSTRUCTION

(76) Inventor: Tony J. Azar, 3555 North Service Road, East Windsor, Ontario (CA), N8W 5R7

( * ) Notice: Subject to any disclaimer, the term of this patent is extended or adjusted under 35 U.S.C. 154(b) by 0 days.

(21) Appl. No.: 10/199,754

(22) Filed: Jul. 18, 2002

(65) Prior Publication Data

US 2003/0014937 A1 Jan. 23, 2003

(30) Foreign Application Priority Data

Jul. 20, 2001 (CA) ..... 2353349

(51) Int. Cl.[7] ..... E04B 2/46

(52) U.S. Cl. ..... 52/604; 52/608; 52/592.6; 52/169.9; 256/19

(58) Field of Search ..... 52/604, 592.6, 52/591.1, 561, 608; 256/19, 169.9, 293.3, 294; 446/105, 106

(56) References Cited

U.S. PATENT DOCUMENTS

| | | | | |
|---|---|---|---|---|
| 2,104,585 A | * | 1/1938 | Dow et al. | 52/609 |
| 5,181,362 A | * | 1/1993 | Benitez | 52/594 |
| 5,623,797 A | | 4/1997 | Gravier et al. | |
| 6,082,067 A | | 7/2000 | Bott | |

FOREIGN PATENT DOCUMENTS

| | | |
|---|---|---|
| CA | 1169686 | 6/1984 |
| CA | 2086706 | 5/1996 |

* cited by examiner

*Primary Examiner*—Brian E. Glessner
*Assistant Examiner*—Naoko Slack
(74) *Attorney, Agent, or Firm*—Anthony J. Casella; Gerald E. Hespos

(57) ABSTRACT

A block for use in construction has opposed front and rear surfaces, opposed top and bottom surfaces, and a pair of opposed ends. The top and bottom surfaces are complementarity profiled to mutually interfit. The end surfaces are shaped to permit a plurality of blocks to be laid in a course with no mortar in between blocks in a course.

8 Claims, 4 Drawing Sheets

CONCRETE BLOCK FOR USE IN FENCE OR BUILDING CONSTRUCTION

FIELD OF THE INVENTION

The present invention relates to the field of concrete construction blocks. In particular, the present invention provides a sound barrier fence made from concrete blocks that is easy to assemble, maintain and repair. Some of the blocks of the present invention are also useful for construction of foundation and other walls of buildings.

BACKGROUND OF THE INVENTION

Sound barrier fences are located beside highways, in urban areas, and serve to deaden vehicular noise from the highway, so that it is not a nuisance in surrounding neighbourhoods. Sound barrier fences may be made from wood, metal or concrete, but are most effective when made of concrete, because of the superior sound deadening characteristics of concrete.

Typically, a sound barrier fence comprises a series of posts, with panels extending between them. The panels may be unitary, or may be made of a series of stacked narrow concrete panels or blocks. The advantage of narrow stacked panels is that each extends from post to post, but the disadvantage is that a long narrow panel is both fragile and very heavy. It must be maneuvered into place by heavy equipment.

A less fragile concrete sound deadening fence construction is shown in U.S. Pat. No. 5,623,797, which shows a sound barrier made of stacked blocks. The blocks interlock loosely at their top and bottom surfaces, but neighbouring blocks in a course of blocks do not interlock.

The present invention provides novel fence blocks for use in constructing a sound barrier fence.

In a broad aspect, therefore, the present invention relates to a block for use in erecting a fence, said block having opposed front and rear surfaces, opposed top and bottom surfaces, and a pair of opposed ends, the top and bottom surfaces being complementarity profiled to mutually interfit, and the end surfaces being shaped to permit a plurality of blocks to be laid in a course with no mortar in between blocks in a course.

BRIEF DESCRIPTION OF THE DRAWINGS

In drawings that illustrate the present invention by way of example.

DETAILED DESCRIPTION

Figure 1:
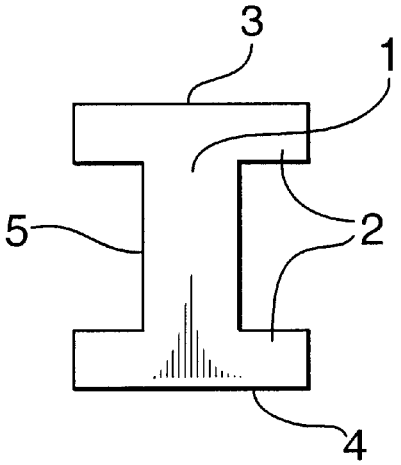
FIG. 1 is an end view of a column for use with the blocks of the present invention.

Referring now to the drawings, in FIG. 1 there is illustrated a column element 1 with flanges extending from the front 3 and rear 4 faces thereof to define channels 5 for receiving the ends of the blocks.

Figure 5:
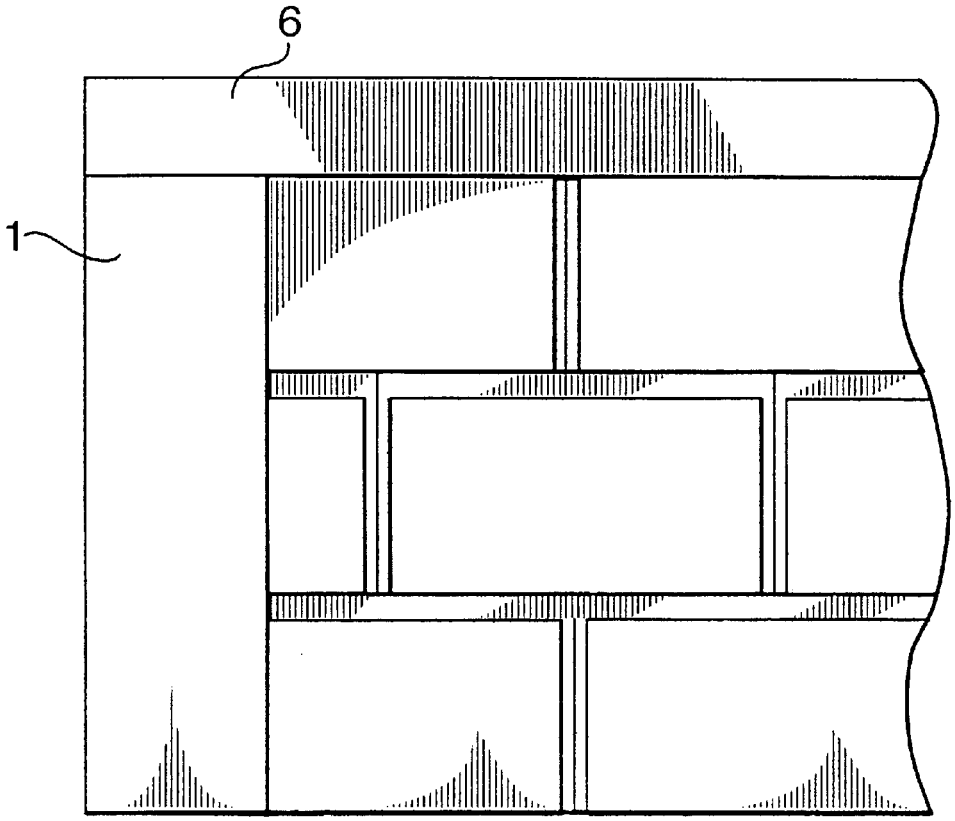
FIG. 5 is a front view of a stacked fence wall according to the present invention.

As shown in FIG. 5, the column may be of any desired length. It is anchored firmly to the ground, for instance by being bolted and grouted to a footing. Additional columns are spaced at regular intervals to define fence posts between which the blocks of the present invention are stacked. The blocks are also stacked on a suitably prepared surface, that may be bevelled and provided with footings if desired. Such preparation is conventional. Moreover, a column element 1 may be fabricated from block-height column element blocks, appropriately cemented together to form a column of any desired length.

Figure 2:
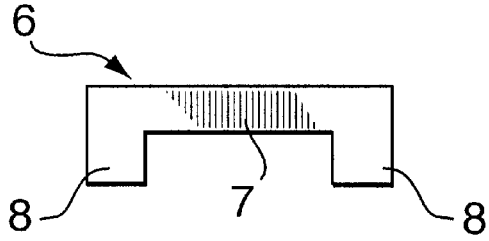
FIG. 2 is an end view of a cap for use with the blocks of the present invention.

A cap 6 for use especially along the top edge of a sound barrier fence according to the present invention is shown in FIG. 2 and FIG. 5. It consists of a main body 7, with flanges 8 depending downwardly therefrom. The cap 6, which is also of indeterminate length, may also be used to finish and end of a wall section, where a full column 1 is not required.

Figure 3:
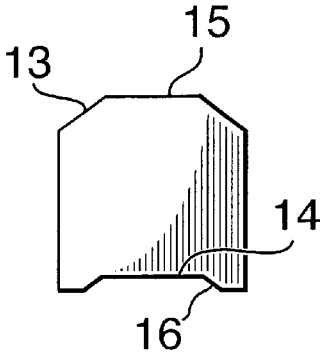
FIG. 3 is an end view of a block according to the present invention, said end view being applicable to each embodiment of the blocks of the present invention.
Figure 4:
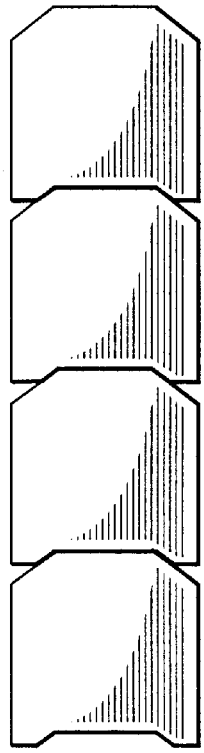
FIG. 4 is an end view of stacked blocks according to the present invention.
Figure 6:
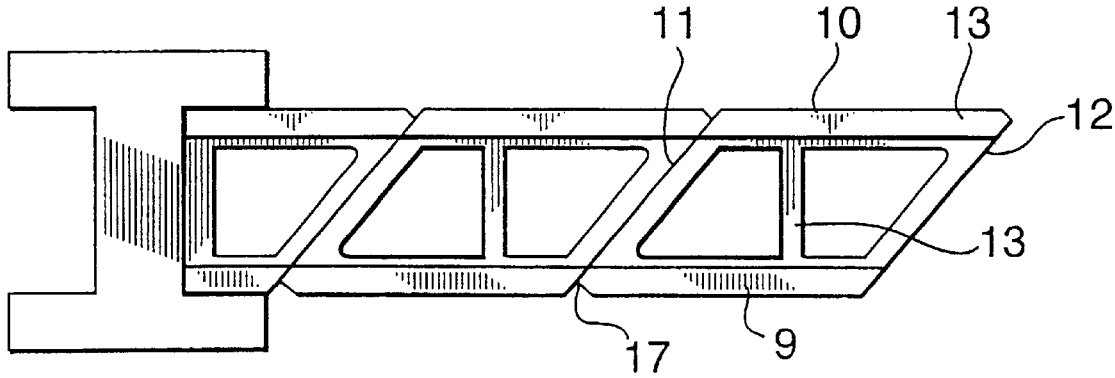
FIG. 6 is a top view of the wall of FIG. 5, but without a cap.
Figure 7:
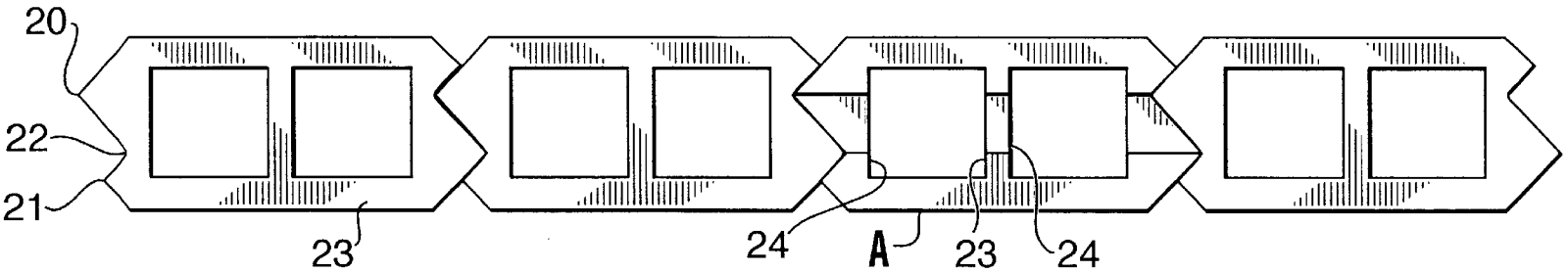
FIG. 7 is a top view of a course of blocks exhibiting a preferred form of the present invention.
Figure 8:
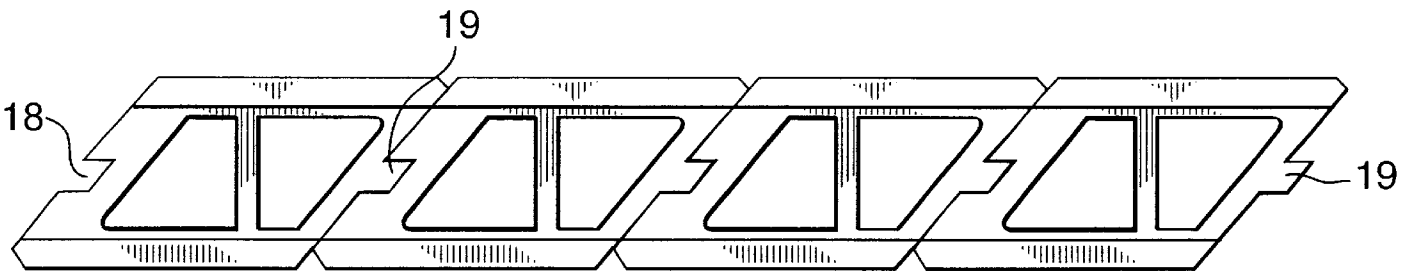
FIG. 8 is a top view of a course of blocks exhibiting another preferred form of the present invention.

Blocks for use in connection with the present invention are fabricated from concrete, and are shown, in top or plan view on FIGS. 6, 7 and 8. In FIG. 6, a basic form of the block of the present invention is shown. It consists of a front wall 9, a rear wall 10, and angled end walls 11, 12. The angled end walls 11, 12 are aligned to the front wall 9 and the rear wall 10 at angles that are not 90°. The angles at diametrically opposite corners of the block preferably are from about 60° to about 30° and most preferably about 45°. The front and rear walls 9/10, are jointed by a web 13 that is at the mid-point of the block. The web reinforces the block structurally, and forms a convenience point to break the block in two as shown in FIG. 6, as will be necessary to insert the block into a column on alternate courses of a wall, if a running bond pattern of block placement is utilized. As shown in FIGS. 3 and 4, the upper edges 13 of the block are beveled, and the lower surface is provided with a shallow groove 14 to interfit with the top surface 15 of the block, with the edges 16 of the groove bearing against the beveled edges of the top surface 15 of the block, to permit the block to be stacked easily.

The outermost end edges 17 of the blocks of the embodiment shown in FIG. 6 are bevelled, so that each block in a wall is outlined by top bevelled edges 13 and side bevelled edges 17, to provide a pleasing masonry appearance.

Referring to FIG. 8, a block that is similar to that shown in FIG. 6 is shown. However, moisture 18, and tension 19 elements are formed in opposing ends of the block, to permit a strong interlocking fit between blocks in a course.

Another preferred embodiment of intermitting block is shown in plan in FIG. 7. Each end of the block of FIG. 7 is provided with a zig-zag profile having a major 20 and a minor 21 peak, and a valley 22 between them. The block exhibits rotational symmetry, whereby the major peak 20 at one end is on the opposite side of the block from the major peak at the other, so that the major peak will fit neatly into the valley of an adjoining block. It will be noted that the blocks of FIGS. 7 and 8, especially FIG. 7, because they interfit, do not have to be laid in a running bond pattern, which makes them more economical to use, and makes it less necessary to waste any block material during construction. The block of FIG. 7, moreover, may also be used as a dry stack block, with only minor modification. That is, if the top surfaces of the ends and central web of the FIG. 7 block are recessed in a semicircular pattern 24, as shown in the block marked 'A' in FIG. 7, the blocks may be stacked together to form a wall with a substantially hollow core, into which concrete may be poured. The purpose of recess 24 is to permit concrete poured into the hollow core of a wall formed with such blocks to flow into all block cores smoothly and efficiently.

Figure 7A:
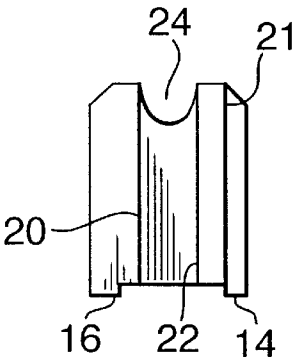
FIG. 7A is an end view of one of the blocks of FIG. 7, adapted for use in general construction.
Figure 9:
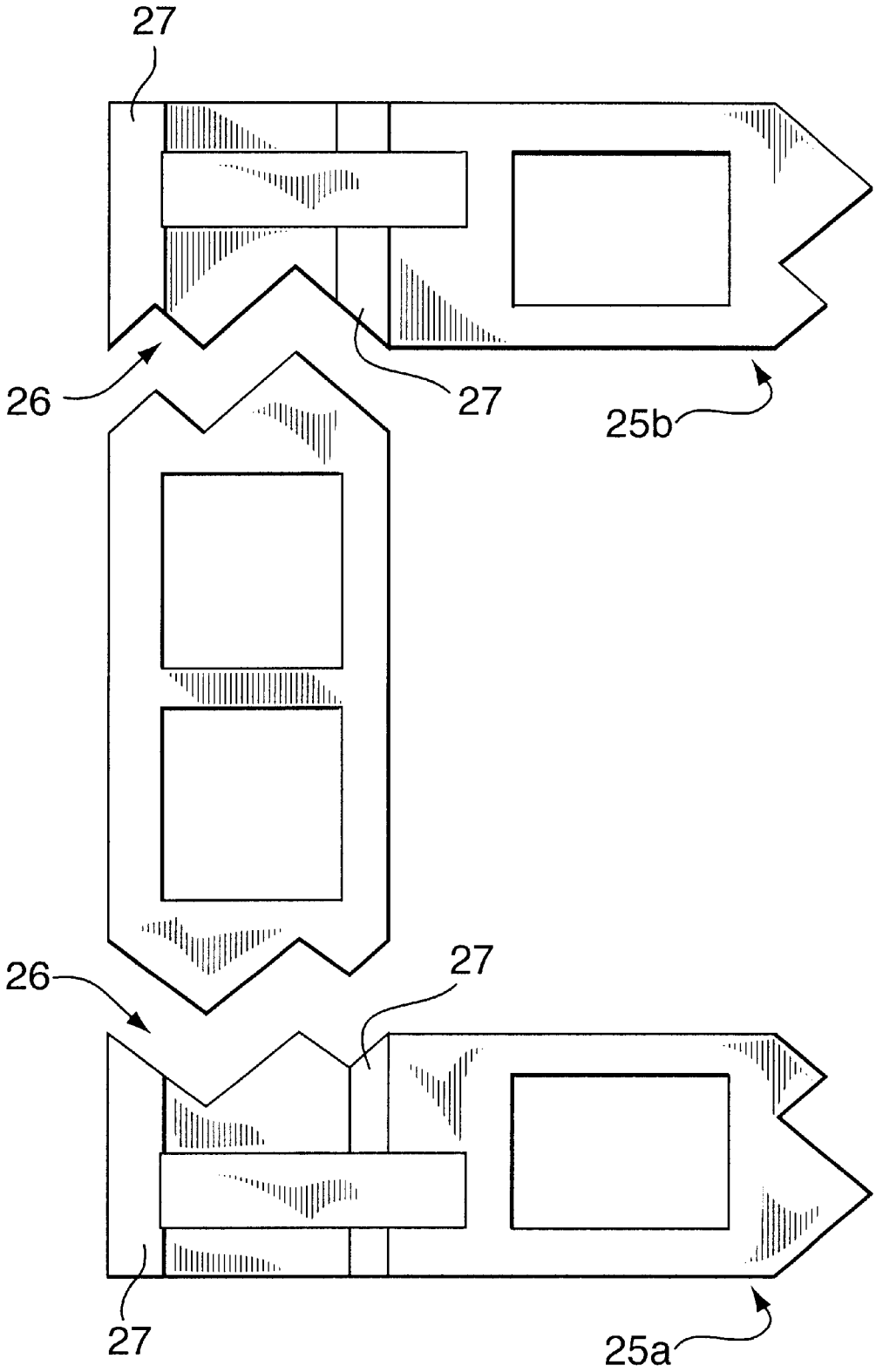
FIG. 9 is a top view of a corner block for use with the block of FIG. 7A.

In FIG. 9 are illustrated corner blocks 25*a* and 25*b* for use with the construction block embodiment of FIG. 7A. Corner blocks 25*a* and 25*b* include a corner element 26 formed in their side surfaces at one end thereof, and bevelled notches 27 in their upper surface corresponding to the lateral edges of the lower surface of the block flanking the edges 16 of groove 14, thereby to permit a block to be laid at 90° on top of corner block 25.

Corner element 26, it will be observed, corresponds in shape to the zig-zag profile of the end of the block of FIG. 7A. The blocks shown in FIG. 9 are a left corner block 25*a* and a right corner block 25*b* which is a mirror image thereof.

It is to be understood that the examples described above are not meant to limit the scope of the present invention. It is expected that numerous variants will be obvious to the person skilled in the field of concrete block design without any departure from the spirit of the invention. The appended claims, properly construed, form the only limitation upon the scope of the invention.

The embodiments of the invention in which an exclusive property or privilege is claimed are defined as follows:

1. A fence system comprising a plurality of wall panels consisting of blocks laid in courses, each of said blocks having opposed front and rear surfaces, opposed top and bottom surfaces, and a pair of opposed ends, the top and bottom surfaces being complementarily profiled to mutually interfit, and the end surfaces being shaped to permit a plurality of the blocks to be laid in a course with no mortar in between blocks in a course, said end surfaces are aligned to said front and rear surfaces at an angle that is not 90 degrees, a vertical stack of courses forming a wall panel, and an I-shaped column element at an end of said wall panel for joining said wall panel to an adjacent wall panel.

2. A fence system as claimed in claim 1 wherein said angle is from about 60° to about 30° at diametrically opposed corners of said block.

3. A fence system as claimed in claim 2 wherein said angle is approximately 45° at diagonally opposed corners of said block.

4. A fence system as claimed in claim 2 wherein one of said ends of each said block includes a tongue and the opposed end of each of said blocks includes a groove, whereby said adjacent blocks in a course interlock.

5. A fence system as claimed in claim 1, wherein said I shaped column elements are made up of a series of stacked I shaped blocks.

6. A fence system as claimed in claim 5, further including C-shaped cap elements for capping the top course of a wall panel, or the end edge of a wall.

7. A fence system as claimed in claim 5, wherein said C-shaped cap elements are made up of a series of C-shaped blocks.

8. A fence system as claimed in claim 7, made form concrete.

* * * * *